US005354647A

United States Patent [19]

Fyson

[11] Patent Number: 5,354,647

[45] Date of Patent: Oct. 11, 1994

[54] BLEACH-FIXERS WITH EXCESS SULPHITE

[75] Inventor: John R. Fyson, Hackney, Great Britain

[73] Assignee: Eastman Kodak Company, Rochester, N.Y.

[21] Appl. No.: 910,361

[22] Filed: Jul. 22, 1992

[30] Foreign Application Priority Data

Jan. 23, 1990 [GB] United Kingdom ..... 9001503.3

[51] Int. Cl.[5] ..... G03C 7/00; G03C 5/44; G03C 5/18; G03C 5/38

[52] U.S. Cl. ..... 430/393; 430/418; 430/428; 430/430; 430/460; 430/461; 430/943

[58] Field of Search ..... 430/393, 428, 429, 430, 430/455, 460, 461, 374, 400, 418, 943

[56] References Cited

U.S. PATENT DOCUMENTS

| | | | |
|---|---|---|---|
| 3,547,636 | 12/1970 | Beach et al. | 430/374 |
| 3,634,263 | 1/1972 | Jargiello | 430/462 |
| 3,700,450 | 10/1972 | Cooley | 96/60 |
| 4,033,771 | 7/1977 | Borton et al. | 430/460 |
| 4,769,313 | 9/1988 | Fujimoto et al. | 430/393 |
| 5,139,929 | 8/1992 | Ishibawa et al. | 430/393 |
| 5,244,778 | 9/1993 | Fyson | 430/393 |

FOREIGN PATENT DOCUMENTS

| | | |
|---|---|---|
| 0199604 | 10/1986 | European Pat. Off. . |
| 0289008 | 11/1988 | European Pat. Off. . |
| 0392481 | 10/1990 | European Pat. Off. . |

OTHER PUBLICATIONS

Derwent's Abstract, No. 89-163 826/22, SU 1 439 523, publ. week 8922.

*Primary Examiner*—Charles L. Bowers, Jr.
*Assistant Examiner*—J. Pasterczyk
*Attorney, Agent, or Firm*—Sarah Meeks Roberts

[57] ABSTRACT

The invention provides a bleach fix agent comprising a dilute solution of an alkaline metal or ammonium thiosulphite or a mixture thereof and iron (III) EDTA together with a soluble sulphite. The invention is characterized in that the soluble sulphite is present in an excess of the amount required for stabilization whereby the sulphite can be sacrificially destroyed by oxidizing agents in use thereby to neutralize the oxidizing effects upon the thiosulphate. The invention is particularly suitable for "RX" processes and results in the possibility of eliminating the stop-bath without allowing staining of the photographic material to occur.

7 Claims, No Drawings

BLEACH-FIXERS WITH EXCESS SULPHITE

The present invention relates to bleach-fixing agents with excess of a soluble sulphite. This invention is particularly concerned with a reduction of cost and complexity of photographic developing processes. The process is particularly suitable for the removal of silver and silver halides from photographic colour materials coated with low weights of silver.

In a process such as this, if a conventional bleach-fix agent of normal strength is utilized to follow the developer, particularly but not exclusively an "RX" developer, severe staining can occur on the developed material.

Traditionally this problem has been addressed by treating the developed materials with a stop-bath before the material enters the bleach-fix bath. The present invention removes the need for a stop-bath because it provides an excess of a soluble sulphite which reacts sacrificially with oxidized developer thereby removing oxidized developer from the bath and the material being processed.

This prevents formation of stain caused by an indiscriminate continuation of coupling, particularly in "RX" development which utilizes oxidizing agents such as hydrogen peroxide and/or cobalt (III) hexammine complexes.

The use of a thiosulphate and iron (III) ethylenediaminetetracetate (EDTA) as a bleach-fixing agent is widespread and is usually combined with a low concentration of a sulphite as a stabilizer. Such compositions are to be found in U.S. Pat. Nos. 3,700,450; 4,769,313 and EP-A-0,289,008 for example.

Traditional high concentration iron (III) EDTA and thiosulphate bleach-fixing agents can be used with low coating weight silver materials with a stop-bath, but the bleach-fix components are not used efficiently and large concentrations of uncomplexed thiosulphate tend to go to waste. This constitutes an unnecessary burden on sewage treatment works as measured by BOD5 or COD. The reduction of the iron complex and thiosulphate concentrations reduces the oxygen demand and iron contamination in the effluent.

Accordingly in the present invention, the thiosulphate and the iron (III) EDTA may be used in concentrations of less than one third of the normal with the sulphite in excess.

U.S. Pat. No. 3,547,636 reveals a process using a bleach/fix agent including at least 0.5 mole of a soluble sulphite and at least an equivalent amount of a thiosulphate.

We have now found that when these bleach-fixing agents are utilized for the removal of silver or silver halides from photographic colour materials, particularly those coated with low weights of silver, for example those of up to 2.1 mg/dm$^2$, it is much to be preferred to reduce the concentration of thiosulphate and iron (III) EDTA since this prevents staining of the product in the absence of a stop-bath.

According therefore to the present invention there is provided in a first aspect a bleach-fix agent adapted for use in the bleach fixing of an exposed photographic colour material with a total silver coating weight of 2.1 mg/dm$^2$ or less, comprising a dilute solution of an alkali metal or ammonium thiosulphate or a mixture thereof, and a photographically effective salt of iron (III) EDTA, together with a soluble sulphite for stabilization of the thiosulphate against decomposition; characterised in that the soluble sulphite is present in an excess of the amount required for stabilization whereby the sulphite reacts with oxidizing components of the developer in use thereby to neutralize its effects upon the thiosulphate.

In a second aspect of the present invention there is provided a method of bleach-fixing an exposed photographic colour material with a total silver coating weight of up to 2.1 mg/dm$^2$, which comprises applying thereto a dilute solution of an alkaline metal or ammonium thiosulphate or a mixture thereof together with a photographically effective salt of iron (III) EDTA admixed with an amount of a soluble sulphite for stabilization of the thiosulphate against decomposition; said soluble sulphite being in excess of the requirement for stabilization thereby to protect the thiosulphate by sacrificial oxidation of said excess of sulphite by carried over oxidizing components of the developer.

In a preferred form of the invention the total thiosulphate is most preferably less than 0.5 molar, and most preferably 0.16 molar or less, when the iron (III) EDTA has a concentration of 0.06 molar or less.

The thiosulphate may be selected from sodium, potassium or ammonium thiosulphate. The sulphite may be a sodium, potassium or ammonium sulphite or a bisulphite salt. The term iron (III) EDTA refers to any photographically effective salt thereof; for example, ammonium, sodium or potassium.

The invention will now be described, by way of illustration only, with reference to the following example.

EXAMPLE

A coating of a colour paper suitable for an "RX" process was made. This coating was of similar construction to the present "all chloride" Kodak (Registered Trade Mark) 2001 paper, having an imaging component silver halide of which 98% is the chloride salt, and 2% is the bromide salt. This 2001 paper has the same dispersion and gel laydowns except that the silver coating weight was reduced to 0.32 mg/dm$^2$ in the red sensitive layer, 0.32 mg/dm$^2$ in the green sensitive layer and 0.75 mg/dm$^2$ in the blue sensitive layer, giving a total silver laydown of 1.4 mg/dm$^2$.

Samples of this coating were exposed sufficiently to give the maximum density when developed. The paper was developed in the following "RX" developer for 30 seconds at 30° C.:

| | |
|---|---|
| potassium carbonate | 30.0 g |
| sodium sulphite | 2.0 g |
| disodium EDTA | 0.1 g |
| CD3 (P-phenylene diamine developing agent) | 8.0 g |
| water to | 1.0 liter |
| pH adjusted to 10.3 with potassium hydroxide solution | |

Just before processing 5 ml 30% hydrogen peroxide was added.

The developed strips were then plunged into an experimental bleach-fix (30° C.) of the following formulation:

| | |
|---|---|
| ammonium iron (III) EDTA solution (1.65) molar | 20 ml |
| ammonium thiosulphate | 15 g |
| sodium sulphite | 15 g |
| water to | 1 liter |

-continued

| |
|---|
| pH adjusted to 6.0 with acetic acid |

These were treated for 20 seconds with good manual agitation. The samples were then washed for 2 minutes, then hung up to dry. The silver remaining in the coating was found to be less than 0.01 mg/dm$^2$ by atomic adsorption spectroscopy. Bleach-fixing was complete in 20 seconds.

The experiment was repeated with unexposed paper. This was compared to a sample of the coating processed with a 30 second stop of 5% acetic acid and a 30 second wash between the developer and the bleach-fix bath, in order to check that no continued coupling occurred. The densities of these processed unexposed areas were within 0.01 in each colour when measured by reflection densitometry. Therefore this bleach-fix caused no significant staining. The same experiment carried out with a conventional bleach-fix showed an increased density of 0.06 in the green density with the process without the stop bath.

In order to test the stability of the bleach-fix towards "RX" developers, 30 ml of the above developer were added to 50 ml of the bleach-fix. The mixture was allowed to stand for 4 days. No precipitate formed.

The above experiments were performed with an "all sodium" bleach-fix of the following formulation:

| | |
|---|---|
| sodium iron (III) EDTA | 15 g |
| sodium thiosulphate | 15 g |
| sodium sulphite | 15 g |
| the pH was adjusted to 6.0 with acetic acid. | |

Again this bleach-fix removed all detectable silver from the coating in 20 seconds, showed no evidence of staining and was stable towards addition of developer.

I claim:

1. A bleach-fix agent adapted for use in the bleach-fixing of an exposed photographic color material with a total silver coating weight of 2.1 mg/dm$^2$ or less, comprising:
   - an alkali metal or ammonium thiosulphate or a mixture thereof at a total thiosulphate concentration of 0.16 molar or less;
   - a photographically effective salt of iron (III) EDTA at a concentration of 0.06 molar or less; and
   - a soluble sulphite in an amount in excess of the amount required for stabilization of said bleach-fix agent, whereby the sulphite reacts with oxidizing components of the developer in use thereby to neutralize said developer's effects upon the thiosulphate.

2. An agent according to claim 1 wherein the amount by weight of said sulphite is greater than or equal to the amount by weight of thiosulphate.

3. An agent claim 1 characterised in that the thiosulphate is selected from sodium, potassium or ammonium thiosulphate, and wherein the soluble sulphite is a sodium, potassium or ammonium sulphite or bisulphite salt.

4. A method of bleach-fixing an exposed photographic color material comprising the steps of:
   - developing an exposed photographic color material having a total silver coating weight of 2.1 mg/dm$^2$ or less using a developer which includes an oxidizing component;
   - applying to said photographic color material a bleach-fix agent comprising
     - an alkali metal or ammonium sulphate or a mixture thereof at a total thiosulphate concentration of 0.16 molar or less:
     - a photographically effective salt of iron (III) EDTA at a concentration of 0.06 molar or less; and
     - a soluble sulphite for stabilization of the thiosulphate against decomposition, wherein said soluble sulphite is present in a concentration in excess of that amount required for stabilization of said bleach-fix agent thereby to protect the thiosulphate by sacrificial oxidation of said excess of said sulphite by carried over oxidizing components from said developer.

5. A method according to claim 4 characterised in that the thiosulphate is selected from a sodium, potassium or ammonium salt and the soluble sulphite, is selected from the sodium potassium or ammonium sulphite or bisulphite salts.

6. A method according to claim 4, wherein said soluble sulphite is present in said bleach-fix agent in an amount by weight greater than or equal to the amount by weight of said thiosulphate.

7. A method according to claim 4, wherein said oxidizing component of said developer is selected from the group consisting of peroxides and cobalt (III) hexammine complexes.

* * * * *